US008517763B2

(12) United States Patent
Burris et al.

(10) Patent No.: US 8,517,763 B2
(45) Date of Patent: Aug. 27, 2013

(54) INTEGRALLY CONDUCTIVE LOCKING COAXIAL CONNECTOR

(75) Inventors: Donald Andrew Burris, Peoria, AZ (US); William Bernard Lutz, Glendale, AZ (US)

(73) Assignee: Corning Gilbert Inc., Glendale, AZ (US)

( * ) Notice: Subject to any disclaimer, the term of this patent is extended or adjusted under 35 U.S.C. 154(b) by 106 days.

(21) Appl. No.: 12/786,992

(22) Filed: May 25, 2010

(65) Prior Publication Data

US 2011/0111623 A1 May 12, 2011

Related U.S. Application Data

(60) Provisional application No. 61/258,871, filed on Nov. 6, 2009.

(51) Int. Cl.
*H01R 9/05* (2006.01)

(52) U.S. Cl.
USPC ..... 439/578

(58) Field of Classification Search
USPC ..... 439/578, 584, 583
See application file for complete search history.

(56) References Cited

U.S. PATENT DOCUMENTS

| | | | | |
|---|---|---|---|---|
| 4,655,159 | A * | 4/1987 | McMills | 116/212 |
| 5,052,947 | A | 10/1991 | Brodie et al. | 439/607 |
| 5,055,060 | A | 10/1991 | Down et al. | 439/304 |
| 5,137,470 | A * | 8/1992 | Doles | 439/578 |
| 5,154,636 | A * | 10/1992 | Vaccaro et al. | 439/583 |
| 5,183,417 | A | 2/1993 | Bools | 439/610 |
| 5,389,005 | A | 2/1995 | Kodama | 439/272 |
| 5,449,296 | A * | 9/1995 | Jacobsen et al. | 439/322 |
| 5,456,614 | A * | 10/1995 | Szegda | 439/321 |
| 5,735,704 | A | 4/1998 | Anthony | 439/271 |
| 5,975,951 | A * | 11/1999 | Burris et al. | 439/585 |
| 6,406,330 | B2 | 6/2002 | Bruce | 439/609 |
| 6,716,062 | B1 | 4/2004 | Palinkas et al. | 439/578 |
| 6,783,394 | B1 * | 8/2004 | Holliday | 439/578 |
| 6,805,584 | B1 | 10/2004 | Chen | 439/578 |
| 6,929,508 | B1 | 8/2005 | Holland | 439/579 |
| 7,029,326 | B2 | 4/2006 | Montena | 439/585 |
| 7,070,447 | B1 | 7/2006 | Montena | 439/578 |
| 7,086,897 | B2 | 8/2006 | Montena | 439/578 |
| 7,114,990 | B2 | 10/2006 | Bence et al. | 439/583 |
| 7,131,868 | B2 | 11/2006 | Montena | 439/578 |
| 7,156,696 | B1 | 1/2007 | Montena | 439/584 |
| 7,229,303 | B2 | 6/2007 | Vermoesen et al. | 439/271 |
| 7,299,550 | B2 | 11/2007 | Montena | 29/857 |
| 7,479,035 | B2 | 1/2009 | Bence et al. | 439/583 |
| 7,607,942 | B1 | 10/2009 | Van Swearingen | 439/578 |

(Continued)

OTHER PUBLICATIONS

US Department of the Army Tech Manual TM 9-1819AC, pp. 284-285, Dec. 1952.

(Continued)

*Primary Examiner* — Neil Abrams
*Assistant Examiner* — Travis Chambers

(57) ABSTRACT

The coaxial connector has a coupling nut, a post, a hollow body, and a ring that prevents interfaces from gapping and provide a robust alternative ground path that also RF shields the connector from both ingress and egress. The ring is biased radially outward to engage the coupling nut, thereby biasing the coupling nut in a rearward direction and, at the same time, biasing the post in a forward direction to engage a terminal.

10 Claims, 6 Drawing Sheets

(56) References Cited

U.S. PATENT DOCUMENTS

| | | | | |
|---|---|---|---|---|
| 7,674,132 | B1 | 3/2010 | Chen | 439/578 |
| 7,753,705 | B2 * | 7/2010 | Montena | 439/277 |
| 7,811,133 | B2 | 10/2010 | Gray | 439/607.41 |
| 7,833,053 | B2 * | 11/2010 | Mathews | 439/578 |
| 7,857,661 | B1 | 12/2010 | Islam | 439/584 |
| 7,892,005 | B2 * | 2/2011 | Haube | 439/321 |
| 7,892,024 | B1 | 2/2011 | Chen | 439/578 |
| 7,927,135 | B1 | 4/2011 | Wlos | 439/584 |
| 8,025,518 | B2 * | 9/2011 | Burris et al. | 439/322 |
| 8,172,612 | B2 | 5/2012 | Bence et al. | 439/578 |
| 8,376,769 | B2 * | 2/2013 | Holland et al. | 439/322 |
| 2006/0166552 | A1 | 7/2006 | Bence et al. | 439/578 |
| 2008/0102696 | A1 | 5/2008 | Montena | 439/578 |
| 2009/0203256 | A1 | 8/2009 | Mathews | 439/583 |
| 2011/0021072 | A1 * | 1/2011 | Purdy | 439/578 |
| 2011/0117774 | A1 * | 5/2011 | Malloy et al. | 439/578 |
| 2011/0117776 | A1 * | 5/2011 | Burris et al. | 439/578 |

OTHER PUBLICATIONS

US Department of the Army Tech Manual TM 9-8024, pp. 418-419, Oct. 1955.

PCT International Product Brochure, HFC Network Division Connectors, 2005-2009, pp. 1-12.

* cited by examiner

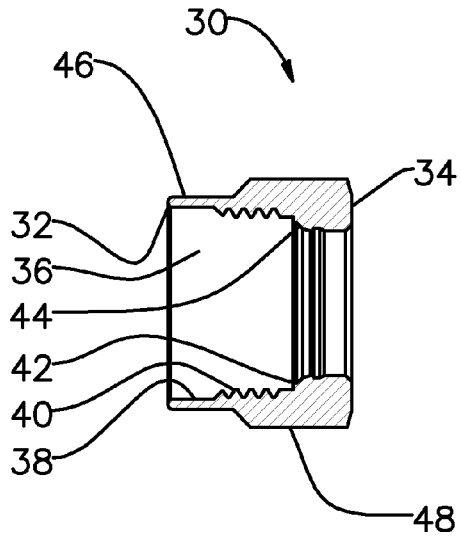
FIG. 2
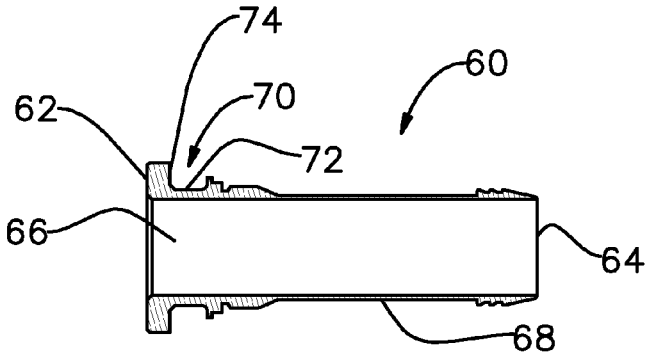
FIG. 3
FIG. 4
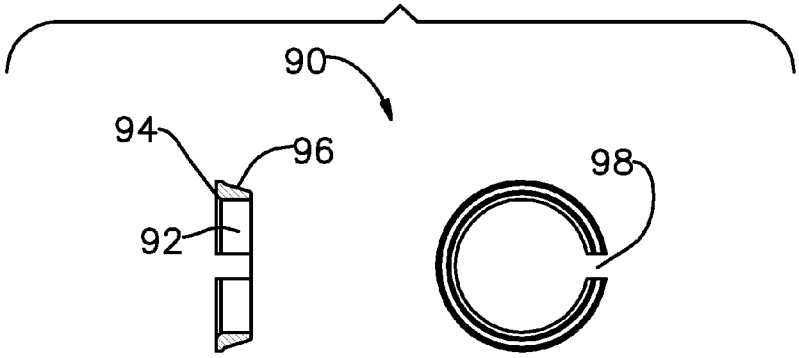

INTEGRALLY CONDUCTIVE LOCKING COAXIAL CONNECTOR

CROSS-REFERENCE TO RELATED APPLICATIONS

This application claims the benefit of, and priority to U.S. Provisional Patent Application No. 61/258,871 filed on Nov. 6, 2009 entitled, "Integrally Conductive Locking Coaxial Connector", the content of which is relied upon and incorporated herein by reference in its entirety.

BACKGROUND OF THE INVENTION

1. Field of the Invention

The present invention relates generally to coaxial cable connectors, and particularly to coaxial cable connectors capable of securely connecting a coaxial cable to a terminal.

2. Technical Background

With the advent of digital signal in CATV systems, a rise in customer complaints due to poor picture quality in the form of signal interference resulting in what is known as "tiling" and the like has also occurred. Complaints of this nature result in CATV system operators having to send a technician to address the issue. Frequently it is reported by the technician that the cause of the problem is a loose F connector fitting. Type F connector fittings may be loose for many reasons; sometimes they are not properly tightened due to installation rules of system operators that prohibit the use of wrenches in-doors on customer equipment. Other times a homeowner may relocate equipment after the technician departs and may not adequately secure the F connectors. Additionally, some claim that F connector coupler loosen due to vibration and/or heat and cold cycles.

Regardless, an improperly installed connector may result in poor signal transfer because there are discontinuities along the electrical path between the devices, resulting in a leak of radio frequency ("RF") signal. That leak may be in the form of signal egress where the RF energy radiates out of the connector/cable arrangement. Alternately, an RF leak may be in the form of signal ingress where RF energy from an external source or sources may enter the connector/cable arrangement causing a signal to noise ratio problem resulting in an unacceptable picture.

Many of the current state of the art F connectors rely on intimate contact between the F male connector interface and the F female connector interface. If for some reason, the connector interfaces are allowed to pull apart from each other, such as in the case of a loose F male coupler, an interface "gap" may result. This gap can be a point of an RF leak as previously described.

To overcome this issue a number of approaches have been introduced including U.S. Pat. No. 7,114,990 (Bence, et al.); U.S. Pat. No. 7,479,035 (Bence, et al.); U.S. Pat. No. 6,716,062 (Palinkas, et al.) and US Patent application 20080102696 (Montena). While these approaches have been successful in varying degrees it is desirable to provide a functioning connector junction that will operate at various stages of engagement.

To address the issue of loosening Type F couplers a number of approaches have been introduced including a lock-washer design produced by Phoenix Communications Technologies International (PCT) known as the TRS connector. While this approach may be somewhat successful in varying degrees, it is desirable to provide a functioning connector junction that will provide an improved locking mechanism.

It would be desirable therefore to provide a coaxial connector that provides a connection without gapping, an alternative ground path, and a way to RF shield both ingress and egress.

SUMMARY OF THE INVENTION

Disclosed herein is coaxial cable connector for coupling an end of a coaxial cable to a terminal, the coaxial cable connector that includes a body, the body comprising a rear end, a front end, and an internal surface extending between the rear and front ends of the body, the internal surface defining a longitudinal opening, a post disposed at least partially within the longitudinal opening of the body, the post comprising a front end and an outer surface, the outer surface having a groove disposed adjacent the front end, a coupling nut disposed proximate the front end of the body to engage a terminal, the coupling nut having a front end and a back end and an opening extending therebetween, the opening having an internal surface, the internal surface having a threaded portion to engage the terminal, a forward facing surface to engage the tubular post and a forward facing inclined surface, and a ring having an internal surface, a forward facing surface, and a rearward facing inclined surface, the ring disposed in the groove between the coupling nut and the tubular post, the ring biased radially outward with at least a portion of the rearward facing inclined surface of the ring engaging at least a portion of the forward facing inclined surface of the coupling nut.

In some embodiments, the coaxial cable connector also includes a sealing member.

In other embodiments, the rotation of the coupling nut on a terminal biases the tubular post against the terminal so as to maintain contact with the terminal.

Additional features and advantages of the invention will be set forth in the detailed description which follows, and in part will be readily apparent to those skilled in the art from that description or recognized by practicing the invention as described herein, including the detailed description which follows, the claims, as well as the appended drawings.

It is to be understood that both the foregoing general description and the following detailed description of the present embodiments of the invention, and are intended to provide an overview or framework for understanding the nature and character of the invention as it is claimed. The accompanying drawings are included to provide a further understanding of the invention, and are incorporated into and constitute a part of this specification. The drawings illustrate various embodiments of the invention, and together with the description serve to explain the principles and operations of the invention.

BRIEF DESCRIPTION OF THE DRAWINGS

FIG. 2 is a cross sectional view of the coupling nut of the coaxial connector of FIG. 1;

FIG. 3 is a cross sectional view of the post of the coaxial connector of FIG. 1;

FIG. 4 is a cross sectional view of the ring of the coaxial connector of FIG. 1;

DETAILED DESCRIPTION OF THE PREFERRED EMBODIMENTS

Figure 1:
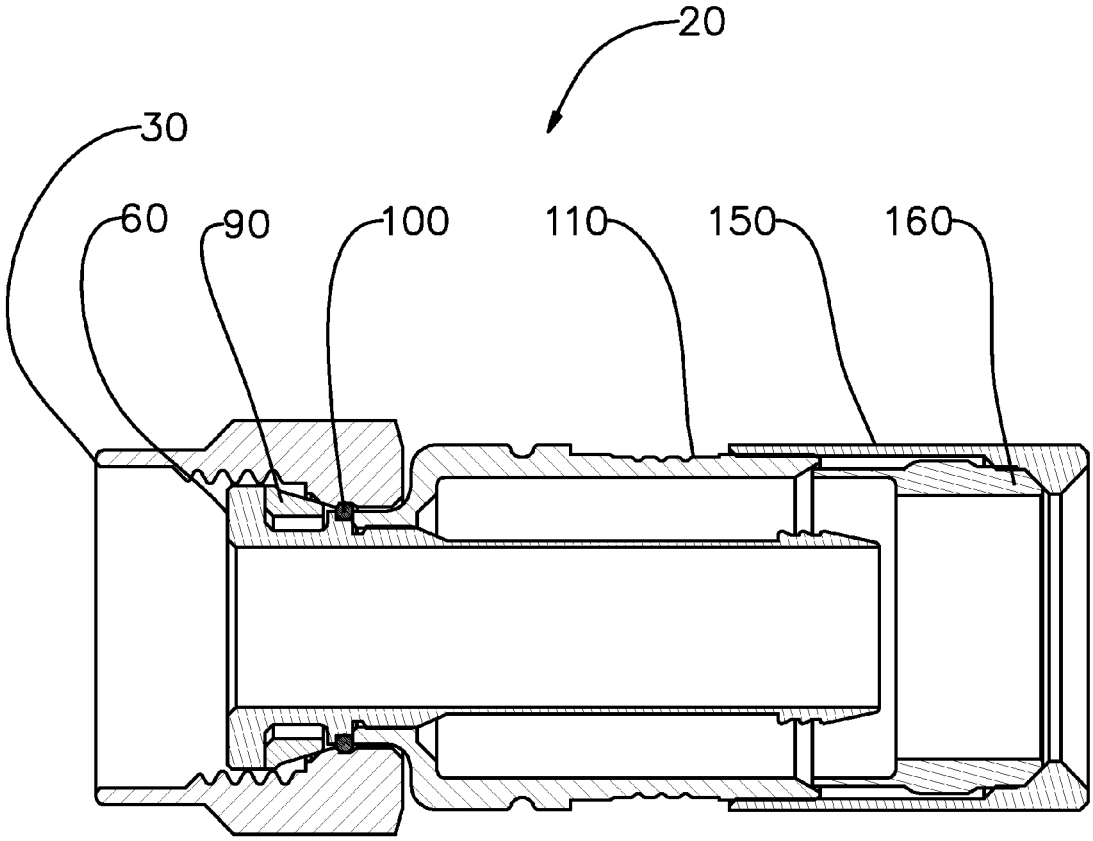
FIG. 1 is a cross sectional view of one embodiment of a coaxial connector according to the present invention prior to engagement.

Reference will now be made in detail to the present preferred embodiment(s) of the invention, examples of which are illustrated in the accompanying drawings. Whenever possible, the same reference numerals will be used throughout the drawings to refer to the same or like parts.

Referring to FIG. 1, a coaxial connector 20 has a coupling nut 30, a post 60, a ring 90, a sealing member 100, a body 110, a gripping member 150, and compression ring 160. The coaxial connector 20 is an axial-compression type coaxial connector and the connection of the coaxial connector 20 to a coaxial cable is known in the art. The coaxial connector 20 is illustrated in FIG. 1 in its unattached, uncompressed state. As described in more detail below, the ring 90 is snap fit onto the post 60. The coupling nut 30 is then disposed over the post 60 and the ring 90. The body 110 is then press-fit over the post 60 (and into the coupling nut 30). Finally, the gripping number 150, with the compression ring 160 disposed therein, is press-fit on to the body 110 to complete the coaxial connector 20. The coupling nut 30 is free to spin around the post 60 in the front portion of the body 110. Also, as described in more detail below, the coupling nut 30 also has limited axial movement so as to be allowed to engage a terminal.

As illustrated in more detail in FIG. 2, the coupling nut 30 has a front end 32, a back end 34, and an opening 36 extending there between. The opening 36 of the coupling nut 30 has an internal surface 38. The internal surface 38 includes a threaded portion 40, a forward facing surface 42 to engage the post 60 and a forward facing inclined surface 44. The coupling nut 30 also has a smooth outer surface 46 adjacent the front end 32 and a hexagonal configuration 48 adjacent the back end 34. The coupling nut 30 is preferably made from a metallic material, such as brass, and it is plated with a conductive, corrosion-resistant material, such as nickel.

The post 60, illustrated in FIG. 3, includes a front end 62, rear end 64, and an opening 66 extending there between. The post 60 also includes an outer surface 68, the outer surface 68 having a groove 70 near the front end 62. The groove 70 also includes a bottom surface 72 and a rearward facing surface 74. The post 60 is also made from a metallic material, such as brass, and it is also plated with a conductive, corrosion-resistant material, such as tin.

FIG. 4 illustrates the ring 90, having a shape that can generally be described as frustoconical. The ring 90 has an internal surface 92, a forward facing surface 94, and a rearward facing inclined surface 96. The ring 90 also has an opening 98 along one side to allow a change in the diameter of the ring 90. The ring 90 is preferably made from a metallic material, such as heat-treated beryllium copper and is an elastic element. That is, the ring 90 can be compressed and expand, as described below.

Figure 5:
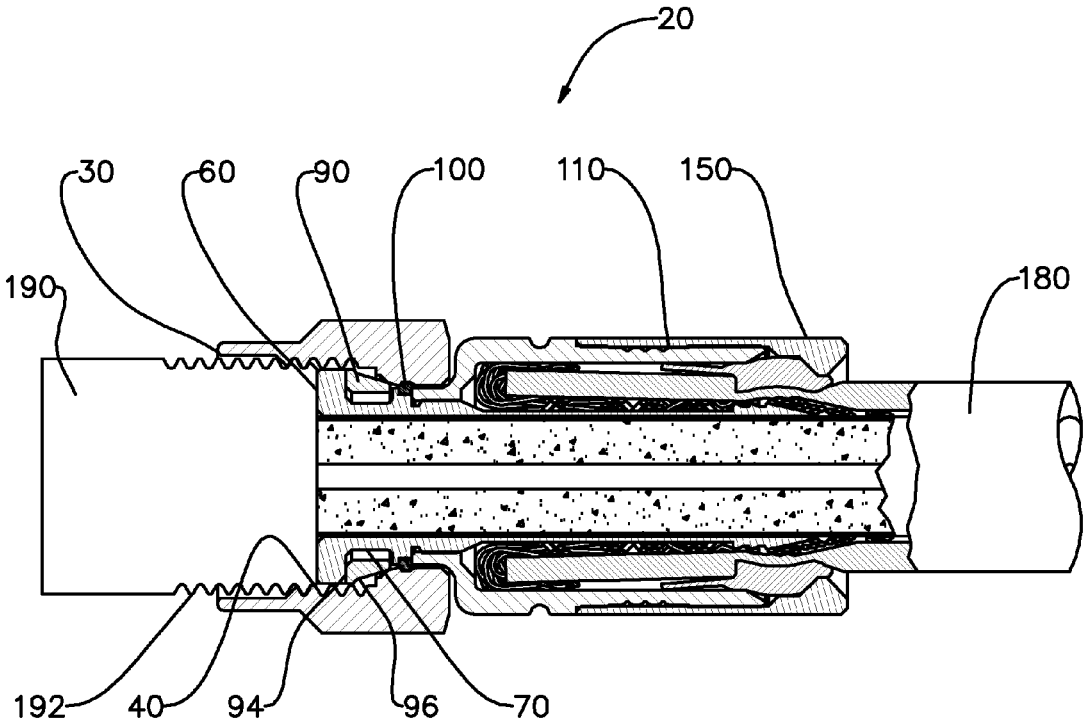
FIG. 5 is a cross sectional view of the coaxial connector of FIG. 1 in partial engagement.

Turning now to FIG. 5, the coaxial connector 20 has been installed onto a coaxial cable 180 as is known in the art. The coupling nut 30 of the coaxial connector 20 has been turned to engage a terminal 190 and, in particular, the threads 192 of the terminal 190. It should be noted that in this configuration, as well as the ready-to-be-shipped configuration of FIG. 1, the coupling nut 30 is biased rearwardly to engage the body 110. The ring 90, disposed in the groove 70, is biased radially outward from the groove 70 so as to engage the coupling nut 30. Preferably, the outer diameter of the ring 90 is larger than the internal diameter of the coupling nut 30, causing the ring 90 to engage the internal surface 38 of the coupling nut 30. The rearwardly facing inclined surface 96 therefore engages the forward facing inclined surface 44 of the coupling nut 30. Since the forward facing surface 94 of the ring 90 engages the rearward facing surface 74 of the groove 70, the coupling nut 30 is biased rearwardly toward the body 110 and relative to the post 60.

It should also be noted in FIG. 5 that the post 60 engages the terminal 190 with just a few turns of the coupling nut 30. Additionally, the coupling nut 30 has not yet begun to move axially toward the terminal 190 relative to the post 60 and the body 110.

Figure 6:
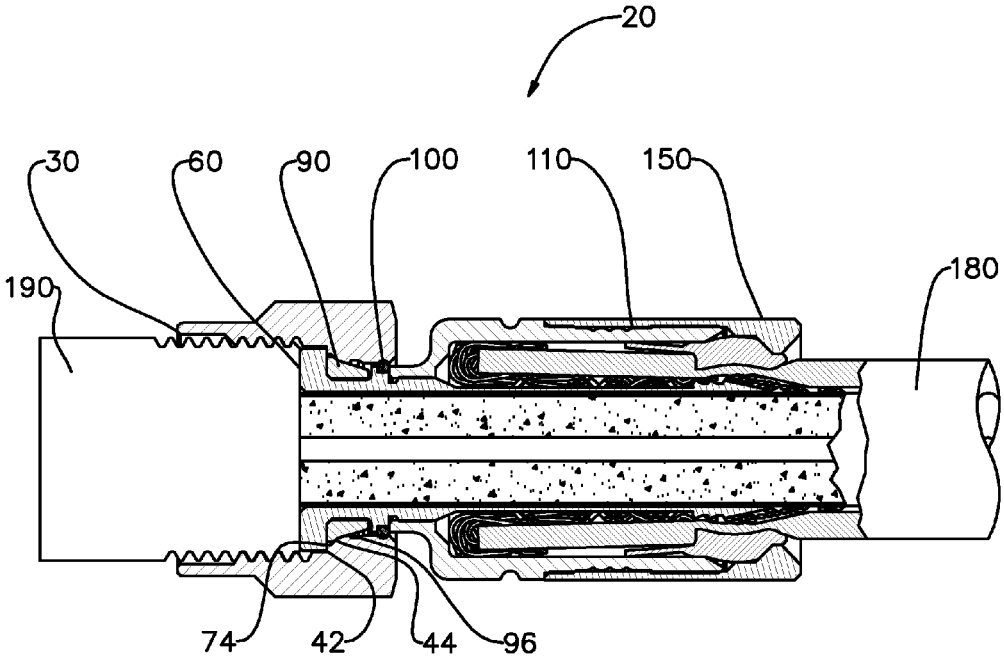
FIG. 6 is a cross sectional view of the coaxial connector of FIG. 1 in full engagement.

FIG. 6 illustrates coupling nut 30 fully engaging the terminal 190. With the post 60 having engaged the terminal 190 at the beginning of engagement and as the coupling nut 30 was rotated onto terminal 190, the coupling nut 30 moved axially forward relative to the post 60 and the ring 90. As can be seen in FIG. 6, the forward facing surface 44 of the coupling nut 30 has moved along the rearwardly facing inclined surface 96, radially compressing the ring 90. Since the forward facing inclined surface 44 of the coupling nut 30 constantly engages the rearwardly facing inclined surface 96 of the ring 90, an alternative ground path is created through the coupling nut 30 and the ring 90. The coupling nut 30 can be rotated until the forward facing surface 42 of the coupling nut 30 engages the rearward facing surface 74 of the post 60. The forward facing inclined surface 44 of the coupling nut 30 engaging the rearwardly facing inclined surface 96 of the ring 90 and the ring 90 engaging the bottom surface 72 of the groove 70 impart both axial and radial forces that both bias, or load, and restrain the coupler nut 30 from rotating.

It should also be noted that the radially outward biasing effect of the ring 90 also tends to center the coupling nut 30 relative to the post 60 (and therefore the center conductor of the coaxial cable 180). The outward biasing of the ring 90 also causes thread loading on the coupling nut 30. Since the coupling nut 30 is biased in a rearward direction (axially), it imparts a force on the threads 192 of the terminal 190. This force assists in maintaining a positive axial engagement between the terminal 190 and the coaxial connector 20. Moreover, when the coaxial connector 20 (and the coupling nut 30 in particular) is unthreaded, the coupling nut 30 will tend to pop off of the terminal 190, returning the coaxial connector 20 to the state illustrated in FIG. 1.

The sealing member 100, illustrated in FIG. 6 as being at the junction of the body 110 and the post 60, prevents moisture and debris from entering into the coaxial connector 20. It should be noted that the coupling nut 30 moves axially forward over the sealing member 100. As illustrated in FIG. 6, the sealing member 100 is an O-ring.

Figure 7:
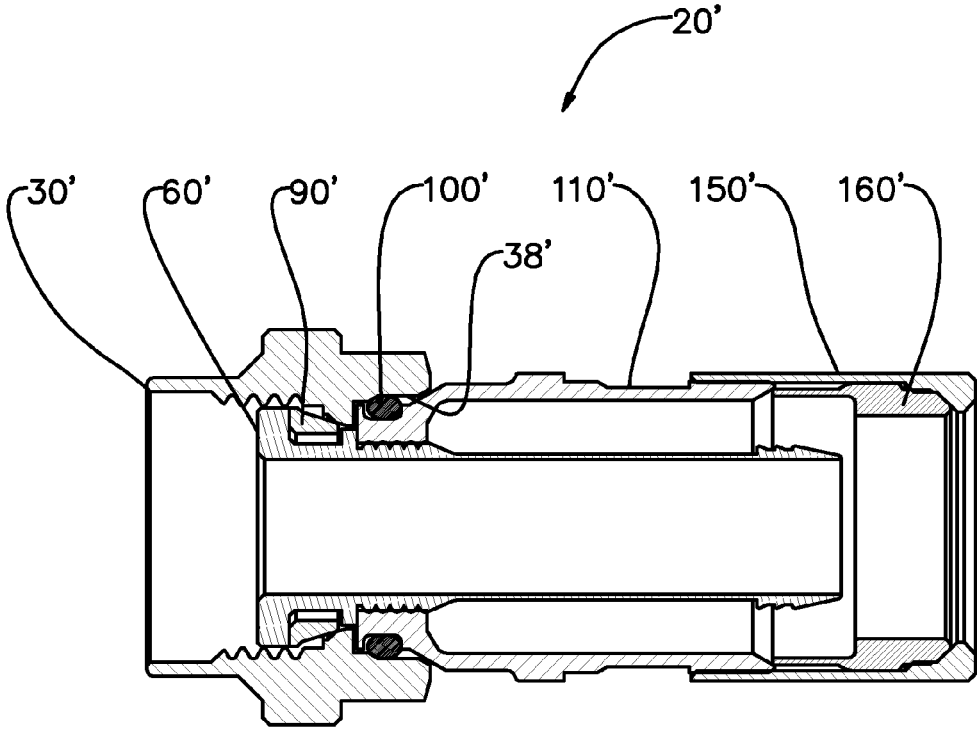
FIG. 7 is a cross sectional view of another embodiment of a coaxial connector according to the present invention prior to engagement.

FIG. 7 illustrates an alternative embodiment of a coaxial connector 20'. The coaxial connector 20' has a larger sealing member 100'. Coaxial connector 20' has a coupling nut 30', a post 60', a ring 90', a sealing member 100', a body 110', a gripping member 150', and compression ring 160'. Generally, the difference in co-axial connector 20' is that the configuration of the internal surface 38' of coupling nut 30' and the outer surface of body 110' are slightly different to accommodate a larger sealing member 100'. Rather than sealing the junction of three components (i.e., the coupling nut, the post, and the body), only the junction of two components are sealed in coaxial connector 20'. The rest of the structure, as well as the workings of, the coaxial connector 20' are the same as the prior embodiment.

Figure 8:
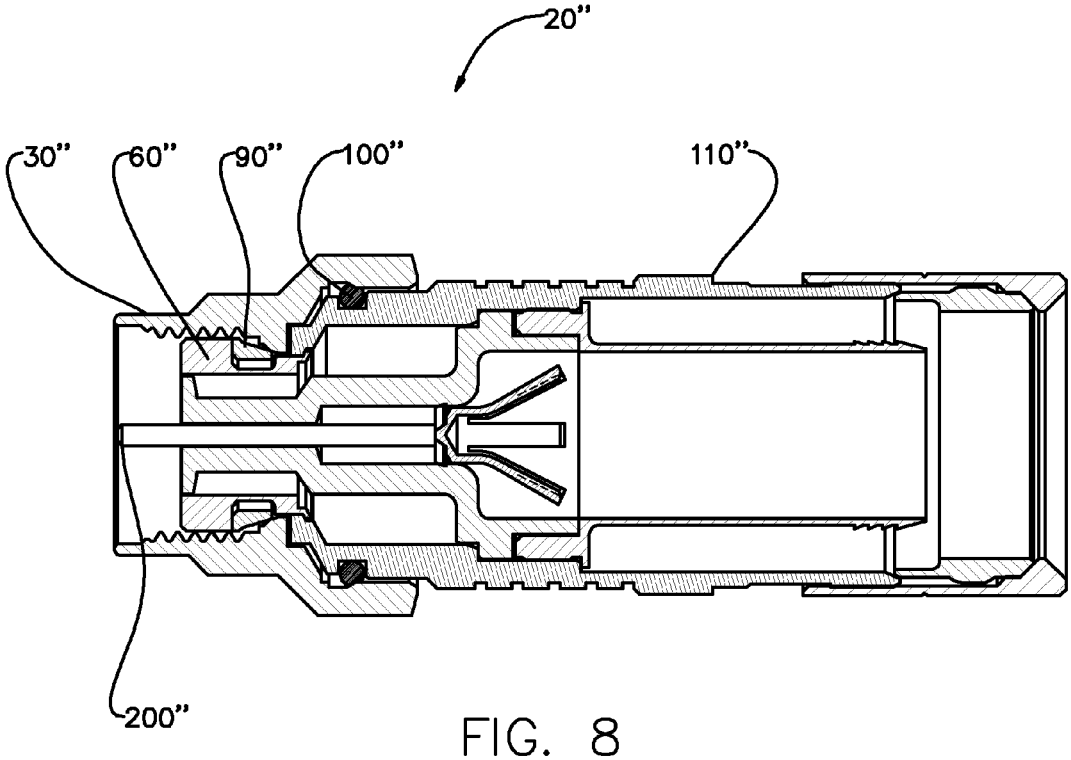
FIG. 8 is a cross sectional view of another embodiment of an coaxial connector according to the present invention prior to engagement.

An alternative embodiment of the coaxial connector 20" is illustrated in FIG. 8 according to the present invention. The coaxial connector 20" includes a coupling nut 30", a post 60", a ring 90", a sealing member 100", and a body 110". The coaxial connector 20" is configured as a pin-type connector arrangement wherein the central conductor 200" and the post 60" remain in contact with the terminal (not shown). The operation of the coupling nut 30", the ring 90", and the post 60" operate in the same fashion as described above with respect to coaxial connector 20.

It will be apparent to those skilled in the art that various modifications and variations can be made to the present invention without departing from the spirit and scope of the invention. Thus, it is intended that the present invention cover the modifications and variations of this invention provided they come within the scope of the appended claims and their equivalents.

What is claimed is:

1. A coaxial cable connector for coupling an end of a coaxial cable to a terminal, the coaxial cable connector comprising:

a body, the body comprising a rear end, a front end, and an internal surface extending between the rear and front ends of the body, the internal surface defining a longitudinal opening;

a post disposed at least partially within the longitudinal opening of the body, the post comprising a front end and an outer surface, the outer surface having a groove disposed adjacent the front end;

a coupling nut disposed proximate the front end of the body to engage a terminal, the coupling nut having a front end and a back end and an opening extending therebetween, the opening having an internal surface, the internal surface having a threaded portion to engage the terminal, a forward facing surface to engage the tubular post and a forward facing inclined surface; and a ring having a general frustoconical shape and having an internal surface, a forward facing surface, and a rearward facing inclined surface, the ring disposed in the groove between the coupling nut and the tubular post, the ring biased radially outward with at least a portion of the rearward facing inclined surface of the ring engaging at least a portion of the forward facing inclined surface of the coupling nut, and wherein the sealing member is disposed between the coupling nut and at least one of the tubular post and the body.

2. The coaxial cable connector according to claim 1, further comprising a sealing member disposed on the internal surface of the coupling nut to prevent moisture ingress.

3. The coaxial cable connector according to claim 1, wherein forward movement of the coupling nut relative to the tubular post radially compresses the ring providing electrical communication between the coupling nut and the tubular post.

4. The coaxial cable connector according to claim 1, wherein the ring biases the coupling nut rearwardly relative to the tubular post when the coaxial cable connector is unconnected to the terminal.

5. The coaxial cable connector according to claim 1, wherein the ring has an opening along one side to allow the ring to change size in diameter.

6. The coaxial cable connector according to claim 1, wherein rotation of the coupling nut on a terminal biases the tubular post against the terminal so as to maintain contact with the terminal.

7. The coaxial cable connector according to claim 1, wherein the internal surface of the ring engages a bottom surface of the groove of the tubular post and the forward facing surface of the coupling nut engages a rearward facing surface of the groove when the connector is fully connected to the terminal.

8. A coaxial cable connector for coupling an end of a coaxial cable to a terminal, the coaxial cable connector comprising:

a body, the body comprising a rear end, a front end, and an internal surface extending between the rear and front ends of the body, the internal surface defining a longitudinal opening;

a post disposed at least partially within the longitudinal opening of the body, the post comprising a front end and an outer surface, the outer surface having a groove;

a coupling nut disposed proximate the front end of the body to engage the terminal, the coupling nut having a front end and a back end and an opening extending therebetween, the opening having an internal surface, the internal surface having a threaded portion to engage the terminal, a forward facing surface to engage the tubular post and a forward facing inclined surface; and a ring having a general frustoconical shape and having an internal surface, a forward facing surface, and a rearward facing inclined surface, the ring disposed in the groove between the coupling nut and the tubular post, the ring biased radially outward creating an annular gap between the internal surface of the ring and the groove when the coaxial cable connector is unconnected to the terminal, and wherein the sealing member is disposed between the coupling nut and at least one of the tubular post and the body.

9. The coaxial cable connector according to claim 8, further comprising a sealing member disposed on the internal surface of the coupling nut to prevent moisture ingress.

10. The coaxial cable connector according to claim 8, wherein the coupling nut moves axially relative to the post during coupling with the terminal.

* * * * *